US006249196B1

(12) United States Patent
Ishigaki et al.

(10) Patent No.: US 6,249,196 B1
(45) Date of Patent: Jun. 19, 2001

(54) RESONATOR FOR UNIFORMLY VARYING INDUCTANCE OR IMPEDANCE IN LONGITUDINAL DIRECTION OF CONDUCTOR LINE

(75) Inventors: Isao Ishigaki; Shuichi Shibuya, both of Fukushima-ken (JP)

(73) Assignee: Alps Electric Co., LTD, Tokyo (JP)

( * ) Notice: Subject to any disclaimer, the term of this patent is extended or adjusted under 35 U.S.C. 154(b) by 0 days.

(21) Appl. No.: 09/460,783

(22) Filed: Dec. 14, 1999

(30) Foreign Application Priority Data

Dec. 21, 1998 (JP) ..... 10-362020

(51) Int. Cl.[7] ..... H01P 7/00; H01P 7/10
(52) U.S. Cl. ..... 333/219; 333/219.1; 333/235
(58) Field of Search ..... 333/219, 219.1, 333/235, 204

(56) References Cited

U.S. PATENT DOCUMENTS 5,208,565 * 5/1993 Sogo et al. ..... 333/206
5,945,895 * 8/1999 Ono ..... 333/206

FOREIGN PATENT DOCUMENTS

2220526 * 10/1990 (GB) .
63-142901 * 6/1988 (JP) .
2-11002 * 1/1990 (JP) .
7-220927 8/1995 (JP) .
8-186461 7/1996 (JP) .

* cited by examiner

*Primary Examiner*—Robert Pascal
*Assistant Examiner*—Patricia T. Nguyen
(74) *Attorney, Agent, or Firm*—Brinks Hofer Gilson & Lione

(57) ABSTRACT

A resonator includes an insulating plate having a circular through hole, an arc-shaped conductor line formed in the periphery of the through hole and on the top face of the insulating plate or in the inner wall of the through hole, a first electrode connected to one end of the conductor line and a second electrode connected to the other end of the conductor line wherein both first electrode and the second electrode are provided on a side face of the insulating plate.

4 Claims, 3 Drawing Sheets

RESONATOR FOR UNIFORMLY VARYING INDUCTANCE OR IMPEDANCE IN LONGITUDINAL DIRECTION OF CONDUCTOR LINE

BACKGROUND OF THE INVENTION

1. Field of the Invention

The present invention relates to resonators having ready-to-use conductor lines mounted with other circuit components on printed circuit boards, and more particularly relates to a resonator in which inductance or impedance may be varied uniformly in the longitudinal direction of a conductor line.

2. Description of the Related Art

A resonator, for example, for determining the oscillating frequency of a voltage-controlled oscillator, has been constructed with a strip conductor line directly formed on a printed circuit board on which other circuit components for the circuit construction are mounted.

FIG. 7 illustrates a conventional resonator. In FIG. 7, a printed circuit board 21 has circuit components (not shown) constituting the voltage-controlled oscillator or the like, mounted thereon. A strip conductor line 22 is directly formed on this printed circuit board 21 and is connected to circuit components.

For example, when the oscillating frequency is adjusted, as shown in FIG. 8, the inductance or the impedance of the resonator is varied by locally changing the width of a slit 23 provided in the conductor line 22.

As described above, the conventional resonator, in which the conductor line 22 is used, is directly formed on the printed circuit board on which circuit components are mounted. Accordingly, in a case where conductor lines 22 having different widths or different lengths are required, since the design for each printed circuit board is different, a universal printed circuit board cannot be designed.

Since the oscillating frequency is adjusted by locally changing the width of the slit 23, the inductance or the impedance of the conductor line 22 varies in accordance with the position of the conductor line 22 in the longitudinal direction thereof. In order to secure the required range of frequency change, the optimal position of the slit 23 must be selected. Moreover, the impedance locally increases in the periphery of the slit 23. Additionally, as the width of the conductor line 22 decreases, loss therein increases and the Q-factor therein decreases.

SUMMARY OF THE INVENTION

Accordingly, it is an object of the present invention to provide a resonator which has a construction allowing it to be mounted on a motherboard in the same manner as other circuit components, thus enabling a universal printed circuit board to be designed, and enabling the inductance or the impedance of the resonator to uniformly vary in the longitudinal direction of the conductor line.

To this end, according to a first aspect of the present invention, there is provided a resonator including an insulating plate having a circular through hole provided, an arc-shaped conductor line formed in the periphery of the through hole and on the top face of the insulating plate or in the inner wall of the through hole, a first electrode connected to one of the edges of the conductor line, and a second electrode connected to the other edge of the conductor line, and wherein the first electrode and the second electrode are provided on a side face of the insulating plate.

This construction allows the resonator to be mounted with other circuit components on the printed circuit board and to be connected to conductors thereon. Therefore, the universal printed circuit board can be achieved by preparing plural resonators, which have different widths and different lengths. Because ground electrodes, and the first and the second electrodes which are connected to the ends of the conductor line, are formed on the side faces of the insulating plate, in the same manner as for other surface-mounted components, it is easy for the resonator to be connected to the printed circuit board.

Moreover, since the width of the conductor line is uniformly changed by cutting edges of the through hole by a drill, there is no discontinuous point in the inductance or the impedance in the longitudinal direction thereof. Thus, there is no risk of loss due to mismatching.

In a resonator according to a first aspect of the present invention, the conductor line may be formed in the periphery of the through hole and on the top face of the insulating plate, a ground conductor may be formed on the bottom face of the insulating plate so as to face the conductor line and a ground electrode, connected to the ground conductor, may be provided on a side face of the insulating plate.

Thus, it is easy to adjust the impedance of the conductor line.

In a resonator according to a first aspect of the present invention, the conductor line may be formed on the inner wall and a ground electrode may be formed on a side face of the insulating plate so as to face the conductor line.

Thus, high Q-factor of the resonator can be maintained. the insulating plate is quadrilateral;

In a resonator according to a first aspect of the present invention, ground electrodes may be provided on three side faces of the insulating plate, and both the first electrode and the second electrode may be provided on the side face of the insulating plate.

Thus, in a case in which the conductor line is mounted on the printed circuit board, the conductor line can be connected to the printed circuit board at the minimum distance.

DESCRIPTION OF THE PREFERRED EMBODIMENTS

Figure 1:
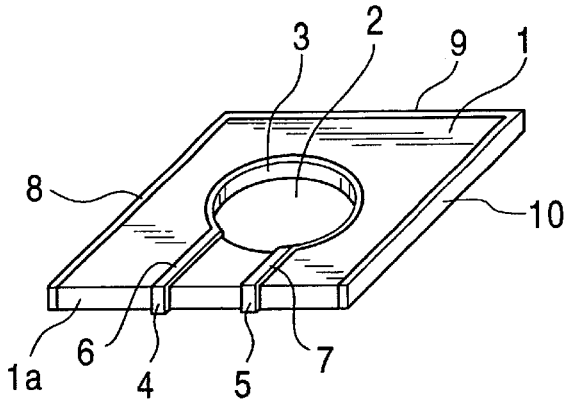
FIG. 1 is a perspective view of a resonator according to a first embodiment of the present invention.
Figure 2:
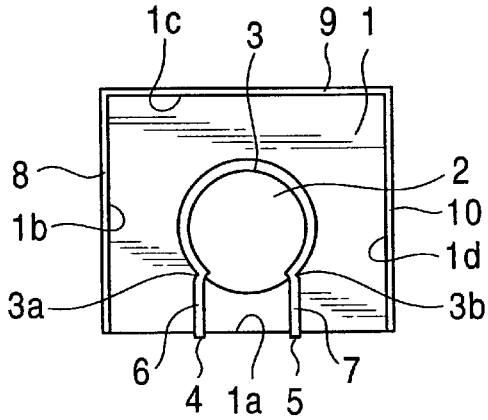
FIG. 2 is a plan view of a resonator according to the first embodiment of the present invention.
Figure 3:
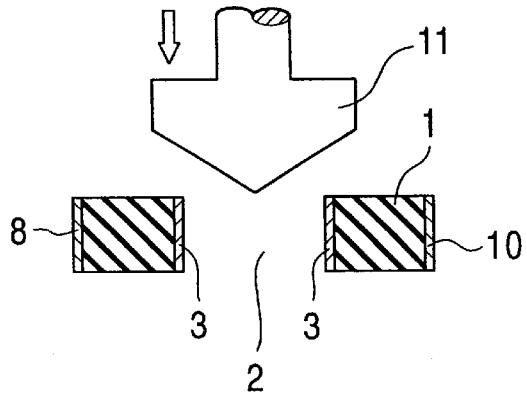
FIG. 3 illustrates processing for adjusting the resonator according to the first embodiment of the present invention.
Figure 4:
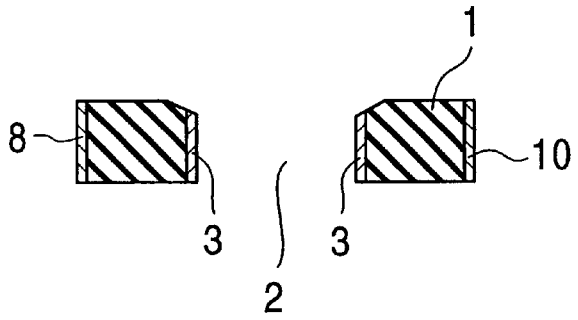
FIG. 4 is a cross-sectional view of a main section of the resonator according to the first embodiment of the present invention.

A resonator according to a first embodiment of the present invention is described with reference to FIGS. 1 to 4. FIG. 1 is a perspective view illustrating the resonator of the present invention; FIG. 2 is a plan view illustrating the resonator in FIG. 1; FIG. 3 illustrates processing of adjusting the resonator of the first embodiment; and FIG. 4 illustrates a cross-sectional view of a main section of the resonator, subsequent to the adjustment thereof.

In FIG. 1, an insulating plate 1 is generally quadrilateral, and a circular hole 2 is provided in the proximity to the center of the insulating plate 1. A conductor line 3 is formed along a circular arc of the inner wall of the hole 2. Ends 3*a* and 3*b* of the conductive line 3 face toward, and are equidistant from, a side la of the insulating plate 1. A side face of the insulating plate 1, having the side 1*a,* includes a first electrode 4 and a second electrode 5 formed thereon. A connection conductor 6, formed on the top face of the insulating plate 1, connects one end 3*a* to the first electrode 4 while a connection conductor 7, formed on the top face of the insulating plate 1, connects other end 3*b* to the second electrode 5.

Ground electrodes 8, 9, and 10 are formed at side faces of the insulating plate which face toward the conductor line 3 and have the other three sides 1*b,* 1*c,* and 1*d* of the insulating plate, respectively. This means that the conductor line 3 faces ground electrodes 8, 9, and 10 via the insulating plate 1, thereby constituting a so-called "microstrip line".

The resonator of the above-described construction is mounted along with the other circuit components, for example, on a printed circuit board (not shown) constituting the oscillator, and is connected to a conductor on the printed circuit board. Since ground electrodes 8, 9, 10, and the first and the second electrodes 4 and 5, are formed on the side faces of the insulating plate 1, in the same manner as for general surface-mounted components, it is easy for the resonator to be mounted on the printed circuit board and to be connected to other components on the printed circuit board.

When the oscillating frequency is adjusted, edges (corners) of the hole 2 are cut by a drill 11 with tapers, as shown in FIG. 3. As a result, the width of the conductor line 3 on the inner wall of the hole 2 is reduced, as shown in FIG. 4, which results in increase in the inductance or the impedance. Thus, the oscillating frequency of the resonator can be adjusted to the desired oscillating frequency. In accordance with such an adjustment, since the width of the conductor line 3 is not narrowed locally, but is narrowed uniformly, the conductor line 3 does not have a discontinuous point in the inductance or the impedance in the longitudinal direction thereof. Hence, there is no risk of loss due to mismatching in the conductor line 3.

The Q-factor, which determines loss in the resonator, depends on the dielectric between the conductor line 3 and ground electrodes 8, 9, and 10; that is, the dielectric loss of the insulating plate 1. By increasing the distance between the conductor line 3 and ground electrodes 8, 9, and 10, the Q-factor can be increased.

Furthermore, because ends 3*a* and 3*b* of the conductive line 3 which face toward, and are equidistant from, the side 1*a* of the insulating plate 1, are connected to the first electrode 4 and the second electrode 5 formed on the side face of the insulating plate 1 having the side 1*a,* the conductor line 3 can be connected to a conductor on the printed circuit board at the minimum distance.

Figure 5:
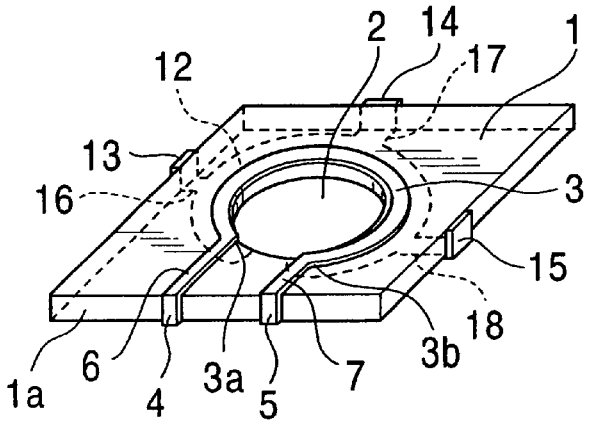
FIG. 5 is a perspective view of a resonator according to a second embodiment of the present invention.
Figure 6:
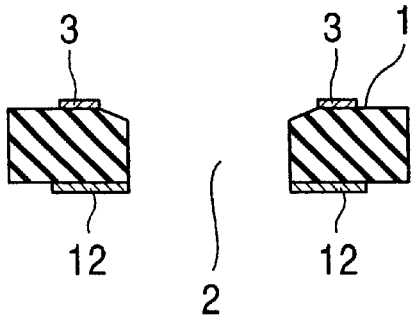
FIG. 6 is a cross-sectional view of a main section of the resonator according to the second embodiment of the present invention.
Figure 7:
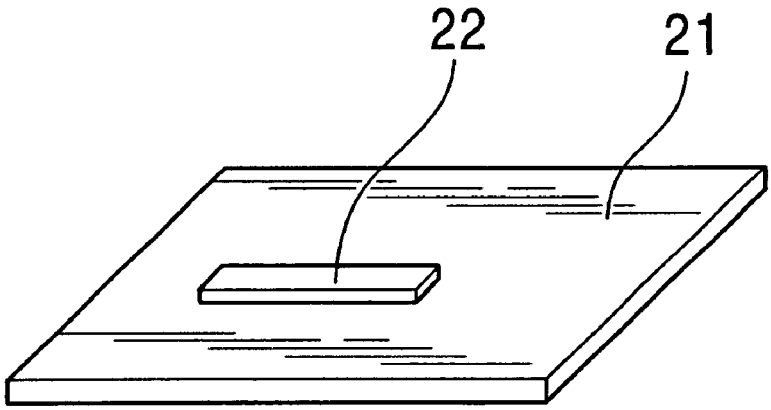
FIG. 7 PRIOR ART
FIG. 7 is a perspective view of a conventional resonator.
Figure 8:
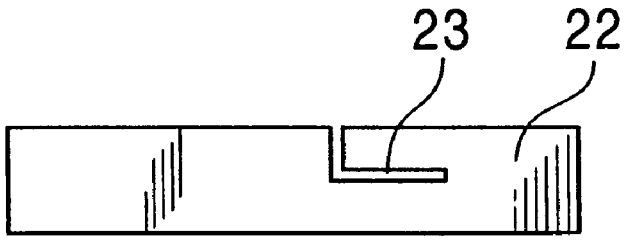
FIG. 8 PRIOR ART
FIG. 8 illustrates processing for adjusting the conventional resonator.

FIGS. 5 and 6 show a resonator according to a second embodiment of the present invention. In FIG. 5, the conductor line 3 is formed having a circular shape in the periphery to the circular hole 2 on the top face of the insulating plate 1 where the hole 2 is provided in the proximity to the center of the insulating plate 1. In the same way as shown in FIGS. 1 and 2, ends 3*a* and 3*b* of the conductive line 3 face toward, and are equidistant from, the side 1*a* of the insulating plate 1. The first electrode 4 and the second electrode 5 are formed on the side face having the side 1*a*. The connection conductor 6, formed on the top face of the insulating plate 1, connects the end 3*a* to the first electrode 4, while the connection conductor 7, formed on the top face of the insulating plate 1, connects the end 3*b* to the second electrode 5.

A ground conductor 12 is formed, facing the conductor line 3, on the bottom face of the substrate 1. Ground electrodes 13, 14, and 15 are properly formed on side faces of the insulating plate 1. Connection conductors 16, 17, and 18, provided on the bottom face of the insulating plate 1, are connected to the ground conductor 12, and to ground electrodes 13, 14, and 15.

As a result, the conductor line 3 faces toward the ground conductor 12 via the insulating plate 1, thereby constituting a so-called "microstrip line".

In this case as well, in order to adjust the oscillating frequency, as shown in FIG. 6, the width of the conductor line 3 can be uniformly narrowed by, cutting edges of the hole 2 with the drill 11 (shown in FIG. 3).

What is claimed is:

1. A resonator comprising:

an insulating plate having a circular through hole;

an arc-shaped conductor line formed in the periphery of the through hole and on the top face of said insulating plate or in the inner wall of the through hole;

a first electrode connected to one end of the conductor line; and a second electrode connected to the other end of the conductor line;

wherein both said first electrode and said second electrode are provided on a side face of said insulating plate.

2. A resonator according to claim 1, wherein the conductor line is formed in the periphery of the through hole and on the top face of said insulating plate;

wherein a ground conductor is formed on the bottom face of said insulating plate so as to face the conductor line; and wherein a ground electrode, connected to said ground conductor, is provided on a side face of said insulating plate.

3. A resonator according to claim 1, wherein the conductor line is formed on said inner wall; and wherein a ground electrode is formed on a side face of said insulating plate so as to face the conductor line.

4. A resonator according to claim 1, wherein said insulating plate is quadrilateral;

wherein ground electrodes are provided on three side faces of said insulating plate; and wherein both said first electrode and said second electrode are provided on the other one side face of said insulating plate.

* * * * *